United States Patent [19]

Augoyard

[11] Patent Number: 4,819,393

[45] Date of Patent: Apr. 11, 1989

[54] DEVICE FOR ANCHORING ONE END OF AT LEAST ONE TENSIONED CABLE OR BAR, IN PARTICULAR FOR A PRESTRESSED CONCRETE STRUCTURE

[75] Inventor: Jean-Pierre Augoyard, Domont, France

[73] Assignee: Gtm-Entrepose, Quentin, France

[21] Appl. No.: 122,547

[22] Filed: Nov. 12, 1987

Related U.S. Application Data

[63] Continuation-in-part of Ser. No. 865,887, May 21, 1986, abandoned.

[30] Foreign Application Priority Data

May 24, 1985 [FR] France ..... 85 07844

[51] Int. Cl.[4] ..... E04C 5/12

[52] U.S. Cl. ..... 52/223 L; 403/370; 403/371

[58] Field of Search ..... 29/517, 452; 52/223 R, 52/223 L, ; 254/29 A; 403/370, 371

[56] References Cited

U.S. PATENT DOCUMENTS

| | | | |
|---|---|---|---|
| 3,139,730 | 7/1964 | Williams et al. | 405/259 |
| 3,184,219 | 5/1965 | Simms | 52/223 L |
| 3,412,511 | 11/1968 | Dietrich | 52/223 L |
| 3,559,270 | 2/1971 | Beghi | 29/517 |

FOREIGN PATENT DOCUMENTS

| | | | |
|---|---|---|---|
| 2541339 | 8/1984 | France | 52/223 L |
| 8507844 | 11/1986 | France . | |

OTHER PUBLICATIONS

German Patent anmeldung L 12,965, V/37db, 18 Oct. 1956, 2 shts drawing, 2 pages specification.

*Primary Examiner*—James L. Ridgill, Jr.
*Attorney, Agent, or Firm*—Amster, Rothstein & Ebenstein

[57] ABSTRACT

A device for anchoring one end of at least one tensioned cable or bar, in particular for a prestressed concrete structure, comprises an anchoring head having at least one conical bore through which the cable or bar is passed, and a set of conical keys located within the bore for clamping the cable or bar therein. A sleeve is attached to the cable or bar at a distance from the largest end face of the conical keys, preferably by drawing. A spacer tube is placed around the cable or bar between the conical keys and the sleeve. The spacer tube cooperates with the sleeve in order to maintain the keys within the conical bore and in order to prevent any relative displacement between the cable or bar and the conical keys in the direction of slackening of these latter.

5 Claims, 3 Drawing Sheets

DEVICE FOR ANCHORING ONE END OF AT LEAST ONE TENSIONED CABLE OR BAR, IN PARTICULAR FOR A PRESTRESSED CONCRETE STRUCTURE

This is a continuation-in-part of co-pending application Ser. No. 865,887 filed on May 21, 1986, now abandoned.

BACKGROUND OF THE INVENTION

1. Field of the Invention

The present invention relates to a device for anchoring the end of at least one tensioned cable or bar, comprising an anchoring head having at least one conical bore through which said cable or said bar is passed, and a set of conical keys located within the bore in order to clamp said cable or said bar therein.

2. Description of the Prior Art

Anchoring devices of the aforementioned type are well-known and are described, for example, in French patent No. FR - 2,541,339. Such devices are employed in particular for prestressing concrete beams. It is necessary for this purpose to apply a considerable tractive force on one end of at least one cable which is encased in a sheath and follows a predetermined path within the beam to be prestressed, the opposite end of said cable or cables being anchored to one end of the beam by means of an anchoring device. When the cable or cables are under tension, that end of the cable or cables on which the tractive force is applied is also anchored to the corresponding end of the beam by means of a second anchoring device. With this objective, the tractive force applied to the cable or cables is relieved to a slight extent and the cable or cables displace the conical keys by frictional contact. The keys are thus jammed and have the effect of locking the cable(s) in position within the conical bore or bores of the anchoring head which is applied against the corresponding end of the concrete beam by means of a bearing plate in order to maintain the cable or cables under tension. Under service conditions, the conical keys remain jammed within the conical bores of the anchoring head under the action of the tensioned cable or cables. It is quite clearly a matter of primary importance to ensure that, when the prestressed beam is in service, the anchoring devices are not liable to release the cable or cables as a result of loosening of the conical keys since the initial tension applied to the cable(s) would otherwise be liable to decrease or even to fall to zero. Such a situation may arise if the cable or cables themselves become slack, for example as a result of failure of a cable strand, as a result of a violent impact applied to the concrete structure or as a result of an earthquake. A substantial reduction in tension of the cable or cables may in fact cause loosening of the conical keys and consequently a movement of relative displacement or slippage between the keys and the cable or cables. This type of situation is not usually attended by any adverse consequences if, after completion of the anchorages, concrete grout has been injected into the sheath which surrounds the prestressed cable or cables since, in this case, the cable or cables are securely maintained by the concrete which bonds them to the sheath and to the concrete structure. On the other hand, the situations mentioned above could be attended by much more troublesome consequences if no mass of concrete grout is injected into the sheath or in cases where the concrete beam is a hollow beam.

It is also a known practice to make use of anchoring devices comprising one or a number of sleeves which are fixed by drawing on the cable or cables to be anchored and which are applied either directly (passive anchoring) or by means of a nut (active anchoring) against one face of a bearing plate provided with at least one opening through which the cable or cables are passed, the other face of said bearing plate being applied against the concrete structure (U.S. Pat. No. 3,559,270). Known anchoring devices of this type do not suffer from the aforementioned disadvantages attached to known devices comprising conical keys but are more complicated to employ in practice since the sleeve or sleeves to be drawn must be very accurately positioned on the cable or cables at the moment of drawing.

SUMMARY OF THE INVENTION

The object of the present invention is to provide an anchoring device of the conical key type in which any relative slippage under service conditions between the cable or cables and the conical keys in the direction of slackening of these latter is prevented.

To this end, the anchoring device in accordance with the present invention is distinguished by the fact that it comprises in addition a sleeve which is secured to said cable or to said bar at a distance from the largest end face of the conical keys, and a spacer tube placed around said cable or around said bar between the conical keys and the sleeve. Said spacer tube is adapted to cooperate with said sleeve in order to maintain said keys within the conical bore of the anchoring head and in order to prevent any relative displacement between the cable or bar and the conical keys in the direction of slackening of these latter.

The spacer tube is able to accomplish this because the sleeve is permanently fixedly secured to the cable or bar at a given distance from the largest end face of the conical keys, and because the spacer tube (which operatively abuts the sleeve at one end and the conical keys at the other end) is longitudinally incompressible.

The sleeve is preferably secured to the cable or bar by drawing the sleeve and the cable or bar through a constricting die.

BRIEF DESCRIPTION OF THE DRAWINGS

Other features of the invention will be more apparent to those skilled in the art upon consideration of the following description and accompanying drawings, wherein.

DESCRIPTION OF THE PREFERRED EMBODIMENT

Figure 1:
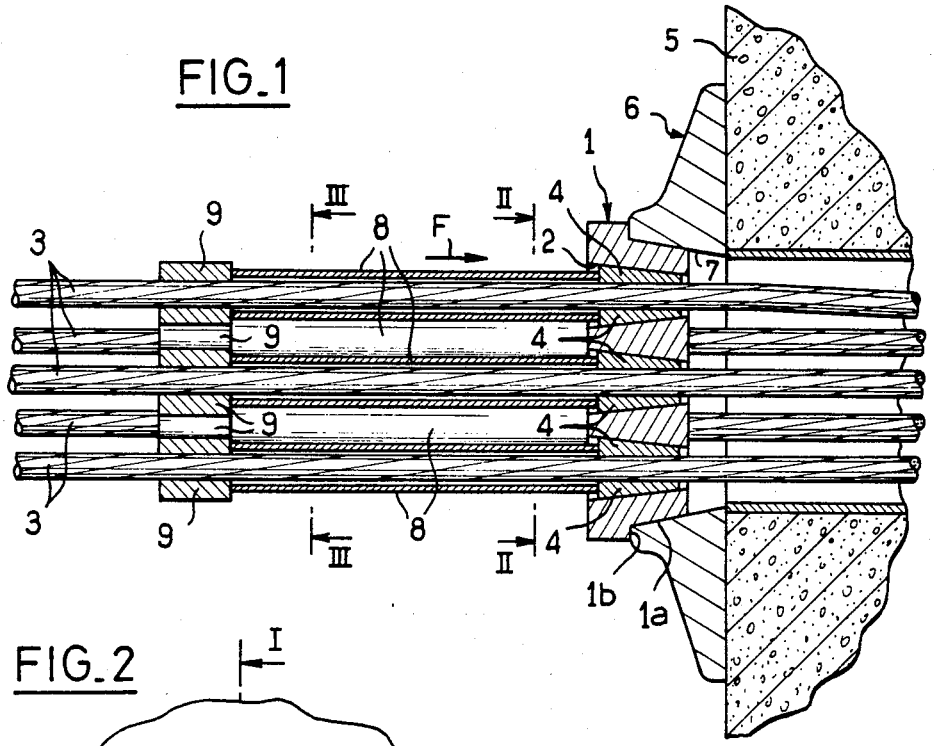
FIG. 1 is an axial sectional view of an anchoring device in accordance with the present invention.
Figure 2:
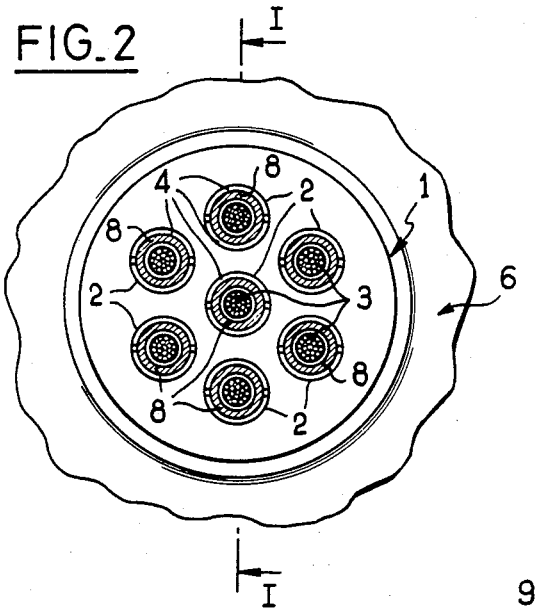
FIGS. 2 and 3 are sectional views taken respectively along lines II—II and III—III of FIG. 1.
Figure 3:
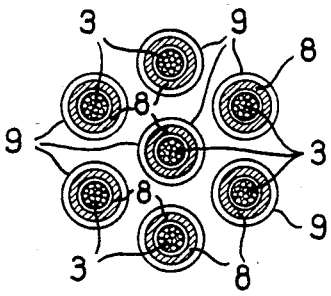
Figure 4:
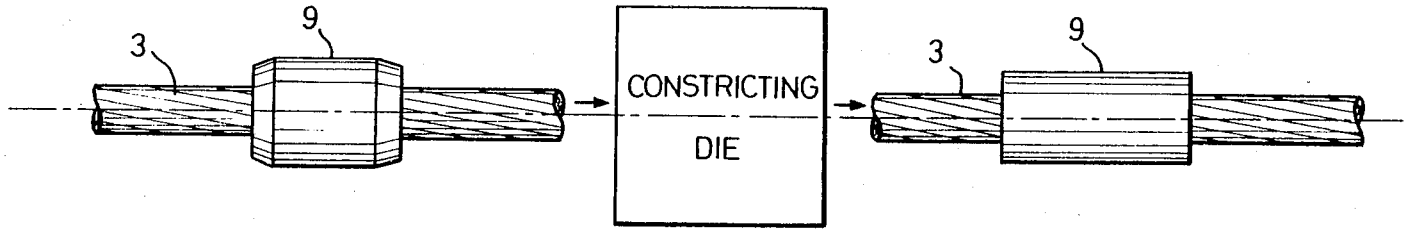
FIG. 4 is a schematic view of a sleeve and cable or bar being secured together by a constricting die.
Figure 4A:
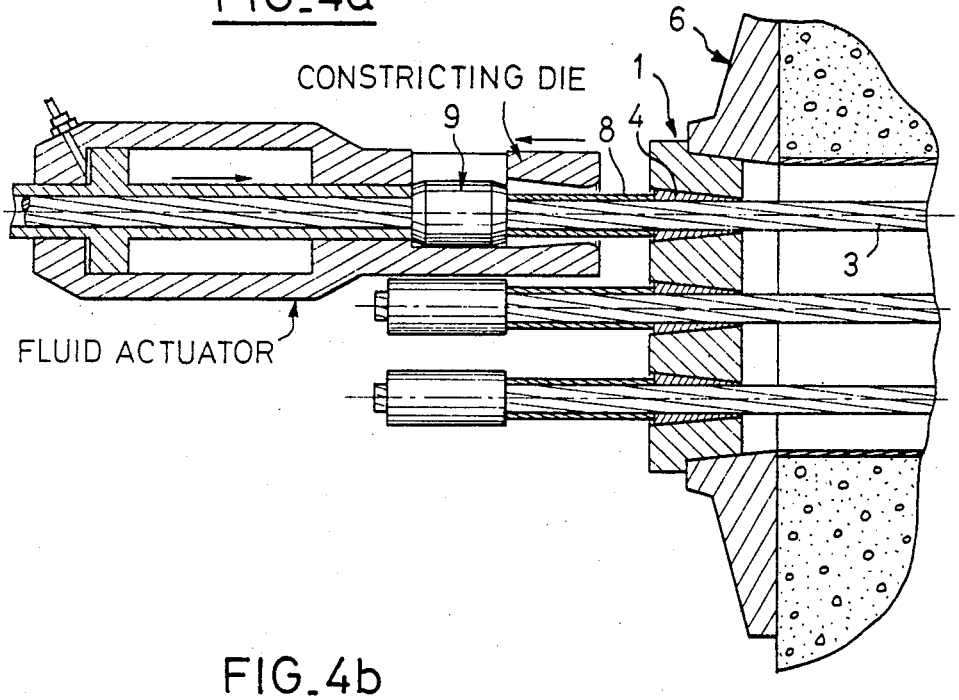
Figure 4B:
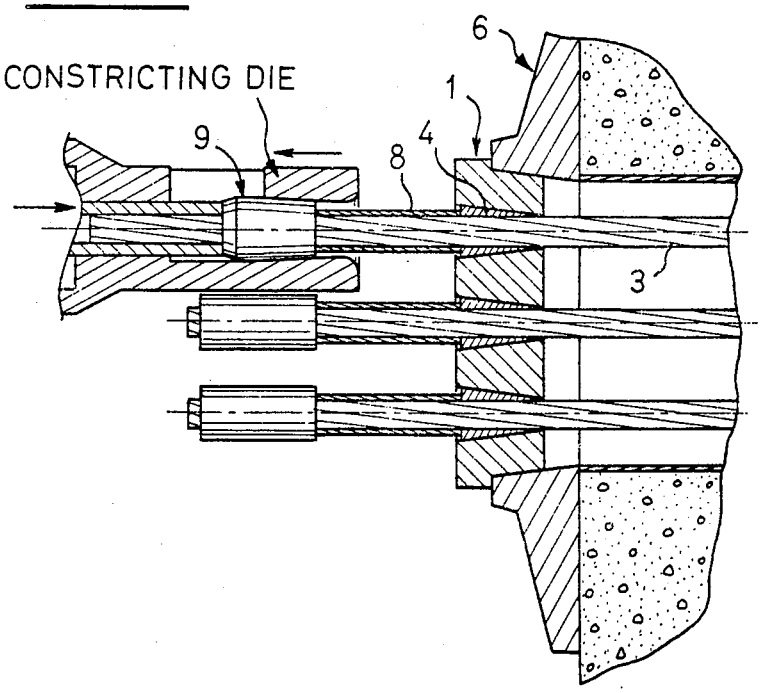

The anchoring device illustrated in FIGS. 1 to 3 comprises an anchoring head 1 having seven conical bores 2 (shown in FIG. 2) through which are passed respectively seven cables 3 consisting of either separate and distinct cables or elementary strands of one and the same cable. A set of conical keys 4 is fitted within each bore 2, provision being made by way of example for two keys per bore. The key faces directed towards the cable 3 are preferably notched or provided with teeth in order to afford a better grip on the cable 3.

The anchoring head 1 is applied against the concrete structure 5 such as a beam, for example, by means of a bearing plate 6. The external surface 1*a* of the anchoring head 1 is conical and the bearing plate 6 is in turn provided with a conical central opening 7 in which is engaged the conical portion 1*a* of the anchoring head. When a tractive force is applied to the cables 3, said force is transmitted to the anchoring head 1 by the conical keys 4 and said anchoring head penetrates into the opening 7 of the bearing plate 6. The depth of penetration can be limited by an annular shoulder 1*b* of the anchoring head 1.

All the anchoring device elements described in the foregoing are well-known and have been disclosed in French Pat. No. FR 2,541,339.

In accordance with the present invention, after the hereinabove described elements of the anchoring device have been positioned on the cables 3 and after these latter have been tensioned in the conventional manner by means of a traction jack and maintained under tension by the conical keys 4 of the anchoring device, a spacer tube 8 is placed on each cable 3, one end of each tube being placed against the largest end face of said conical keys 4. A sleeve 9 is then placed on each cable 3 in contact with the other end of the tube 8 and each sleeve 9 is attached to the corresponding cable 3. Preferably, the attachment of each sleeve 9 to the corresponding cable 3 is carried out by drawing the sleeve through a die. The drawing operation is preferably performed on each sleeve 9 while the corresponding cable 3 is subjected to a tractive force. Thus, when the tractive force applied to the cable 3 is released after attachment of the sleeve 9 to the cable, the internal tension of the cable is then transmitted to the sleeve 9 which thrusts back the spacer tube 8 in the direction of the arrow F (as shown in FIG. 1) and the tube 8 tends in turn to exert a thrust on the keys 4 and to maintain them within the conical bore 2.

Under these conditions, if the cables 3 become momentarily slack during service (for example in one of the situations mentioned earlier) and if this results in loosening of the keys 4, the spacer tubes 8 and the sleeves 9 cooperate in order to prevent the keys 4 from passing out of the conical bores 2 of the anchoring head 1. Furthermore, it will be noted that, even if the keys 4 escape from the conical bores 2 to a partial extent as a result of a momentary decrease in tesion of the cables 3, the spacer tubes 8 and the sleeve 9 prevent any displacement of the keys 4 with respect to the cable 3 in the direction opposite to the arrow F. The result thereby achieved is that the cables 3 would not be liable to slip in the direction of the arrow F with respect to the keys 4 if these latter were to work loose during service. As soon as the decrease in tension of the cables 3 ceases, the keys 4 again produce a clamping action on the cables without any reduction in the tension to which they had initially been subjected.

The method of drawing a sleeve and cable through a constricting die to secure the two elements together is well known and need not be expounded upon further herein. For example, see U.S. Pat. No. 3,559,270, the specification and drawings of which are hereby incorporated by reference.

From the foregoing it will be appreciated that critical features of the present invention include the permanent fixing of the sleeve to the cable 3 in such a manner as to preclude relative longitudinal motion between the sleeve 9 and the cable 3 when either is pulled in either direction and the longitudinal incompressibility of the spacer tube 8 so that, when the spacer tube 8 operatively abuts the sleeve 9 at one end and the conical keys 4 at the other end, the sleeve 9 acts through the spacer tube 8 to preclude shortening of the given longitudinal distance between the sleeve 9 and the conical keys 4. As a result of these features, the sleeves 9 and spacer tubes 8, as earlier noted, prevent any displacement of the keys 4, with respect to the cable 3 in the direction opposite to the arrow F, even if the keys 4 escape from the conical bores 2 to a partial extent (for example, as a result of a momentary decrease in tension of the cable 3). Similarly, as a result of these features, the internal tension of the cable 3 is transmitted to the sleeve 9 which, as earlier noted, thrusts back against the spacer tube 8 in the direction of the arrow F to exert an undiminished thrust on the keys 4 and maintain them within the conical bores 2.

The term "permanently fixedly secured", as used in the specification and claims, is defined as the fixing of two elements together so as to prevent relative longitudinal motion therebetween, regardless of which element is moved in which longitudinal direction—in other words, the two elements are joined together for longitudinal movement together as a unit. More particularly, the sleeve can be permanently fixedly secured to the cable by any of a variety of fixing means well known to those skilled in the construction industry and recognized as preventing relative longitudinal motion between a sleeve and cable, regardless of whether the sleeve or cable is pulled relative to the other element in one longitudinal direction or another. For example, the sleeve may be fixed to the cable by welding, bonding (that is, through the use of adhesives), crimping, set screws, drawing and the like. In the preferred technique, the sleeve is placed in position about the cable and both sleeve and cable are caused to be moved relatively through a constricting die. The constricting die is preferably formed of two segments so that the segments can be joined together during the drawing operation and thereafter at least partially separated to facilitate removal of the die from the cable. A preferred practice of the technique contemplates movement of the constricting die over a stationary sleeve and cable, but clearly the technique also encompasses the movement of the sleeve and cable through a stationary constricting die as well. The drawing of the sleeve through the die causes the sleeve to constrict radially inwardly in order to firmly fix it to the cable or bar such that in the ordinary course of events the two are permanently fixed together for movement as a unit.

The term "longitudinally incompressible," as used in the specification and claims, is defined as the ability of the spacer tube 8 to withstand a longitudinal compression load of 80% of the breaking strength of the cable 3 without shortening or compressing by more than 2% of its total length. For example, with a cable 3 having a breaking strength of 25 tons and a maximum internal tension of 20 tons, a spacer tube having a length of 100 millimeters, when place under a compression load of 20 tons should not undergo a longitudinal constriction or shortening of more than 2 millimeters. The longitudinal compressibility of a spacer tube will be affected by various considerations well known to those in the material arts—for example, the composition from which the spacer tube is constructed, the cross-sectional design of the spacer tube, the special treatments to which the spacer tube has been subjected (e.g., annealing), and the like. Preferably the spacer tube is devoid of any longitudinally-acting biasing means (such as compression springs) and any longitudinally movable components (such as piston or piston/cylinder combinations). Such longitudinally-acting biasing means and longitudinally movable components typically cause the spacer tube to fail the definition of "longitudinally incompressible" and, even if they do not, they introduce potential failure modes which are preferably avoided. Preferably the spacer tube 8 has an outer diameter which is less than the maximum outer diameters of the sleeve 9 at one end or the conical keys 4 at the other end.

It will be wholly apparent that the embodiment of the present invention described in the foregoing has been given solely by way of example without any limitation being implied. Thus any number of modifications may readily be made by those versed in the art without thereby departing either from the scope or the spirit of the invention. Accordingly, although the present invention has been described in connection with a particular form of construction of the anchoring head 1 and of the bearing plate 6, this invention is also applicable to other known designs of the anchoring head and of the bearing plate. In particular, said bearing plate can even be formed in a single piece with the anchoring head. It may be stated in general terms that the present invention is applicable in all cases in which one or a number of cables are clamped by means of conical keys within one or a number of conical bores of an anchoring head. Furthermore, although the spacer tubes 8 and sleeves 9 consist of separate elements in the embodiment shown in FIG. 1, each spacer tube 8 can be formed in one piece with the associated sleeve 9.

What is claimed is:

1. A device for achoring one end of at least one tensioned cable or bar, comprising an anchoring head having at least one conical bore through which the cable or bar is passed, and a set of conical keys located within the bore in order to clamp the cable or bar therein, wherein said device further comprises a sleeve which is permanently fixedly secured to the cable or bar at a distance from the largest end face of said conical keys, and a given spacer tube disposed around the cable or bar between said conical keys and said sleeve and adapted to cooperate with said sleeve in order to maintain said conical keys within said conical bore of said anchoring head and in order to prevent any relative displacement between the cable or bar and said conical keys in the direction of slackening of said conical keys, said spacer tube being longitudinally incompressible and operatively abutting said sleeve at one end and said conical keys at the other end.

2. An anchoring device according to claim 1, wherein said spacer tube has an outer diameter less than the maximum outer diameters of said sleeve and said conical keys.

3. An anchoring device according to claim 1, wherein said spacer tube is formed in one piece with said sleeve.

4. An anchoring device according to claim 1, wherein said sleeve is secured to the cable or bar by drawing said sleeve and the cable or bar through a constricting die.

5. An anchoring device according to claim 4 wherein said spacer is devoid of longitudinally-acting biasing elements and longitudinally moving components.

* * * * *